US006545079B1

(12) United States Patent
Nurmi et al.

(10) Patent No.: US 6,545,079 B1
(45) Date of Patent: Apr. 8, 2003

(54) METHOD OF FORMING A TRANSPARENT AND GAS-PERMEABILITY DECREASING COATING TO A PAPER OR BOARD WEB AND A COATING FORMULATION FOR THE METHOD

(75) Inventors: Kari Nurmi, Raisio (FI); Kimmo Santamäki, Raisio (FI); Tom Carne, Copenhagen (DK)

(73) Assignee: Raisio Chemicals Oy, Raisio (FI)

( * ) Notice: Subject to any disclaimer, the term of this patent is extended or adjusted under 35 U.S.C. 154(b) by 0 days.

(21) Appl. No.: 09/449,866

(22) Filed: Nov. 29, 1999

Related U.S. Application Data

(63) Continuation-in-part of application No. PCT/FI98/00406, filed on May 13, 1998.

(30) Foreign Application Priority Data

May 28, 1997 (FI) ..... 972246

(51) Int. Cl.[7] ..... C08K 3/34

(52) U.S. Cl. ..... 524/451; 524/13; 428/496; 428/507

(58) Field of Search ..... 524/451, 13; 428/496, 428/507

(56) References Cited

U.S. PATENT DOCUMENTS 3,790,402 A 2/1974 Eastes ..... 117/68
5,635,279 A 6/1997 Ma et al. ..... 428/174

FOREIGN PATENT DOCUMENTS

| | | |
|---|---|---|
| EP | 0 543 793 A1 | 5/1993 |
| GB | 2 019 822 A | 11/1979 |
| WO | WO 96/15321 | 5/1996 |
| WO | WO 96/22329 | 7/1996 |

OTHER PUBLICATIONS

"Handbook of Fillers for Plastic's", Katz et al ed. (1987).*

Database B–Door, Accession No. 79–88860, Cellulose Paper Ind. Res: "Cardboard–Chalking Compsns. for Use in Printing—Contg. Talc, Kaolin, Sodium Salt of Carboxymethyl Cellulose and Glyoxal for Strength and Moisture Resistance"& SU,A,652253, 790320, DW7949.

* cited by examiner

*Primary Examiner*—Edward J. Cain
(74) *Attorney, Agent, or Firm*—Connolly Bove Lodge & Hutz, LLP

(57) ABSTRACT

The present invention relates to method of forming a transparent and gas-permeability decreasing coating by virtue of applying a coating containing at least one polymer dispersion on a sheet of paper, board or similar cellulosic fiber based web in at least one coating step. The method according to the invention is based on the use of a polymer dispersion containing extremely pure talc particles having a degree of purity of 90–100% and a particle size of 90% smaller than 40 $\mu$m.

13 Claims, 2 Drawing Sheets

Figure 1:
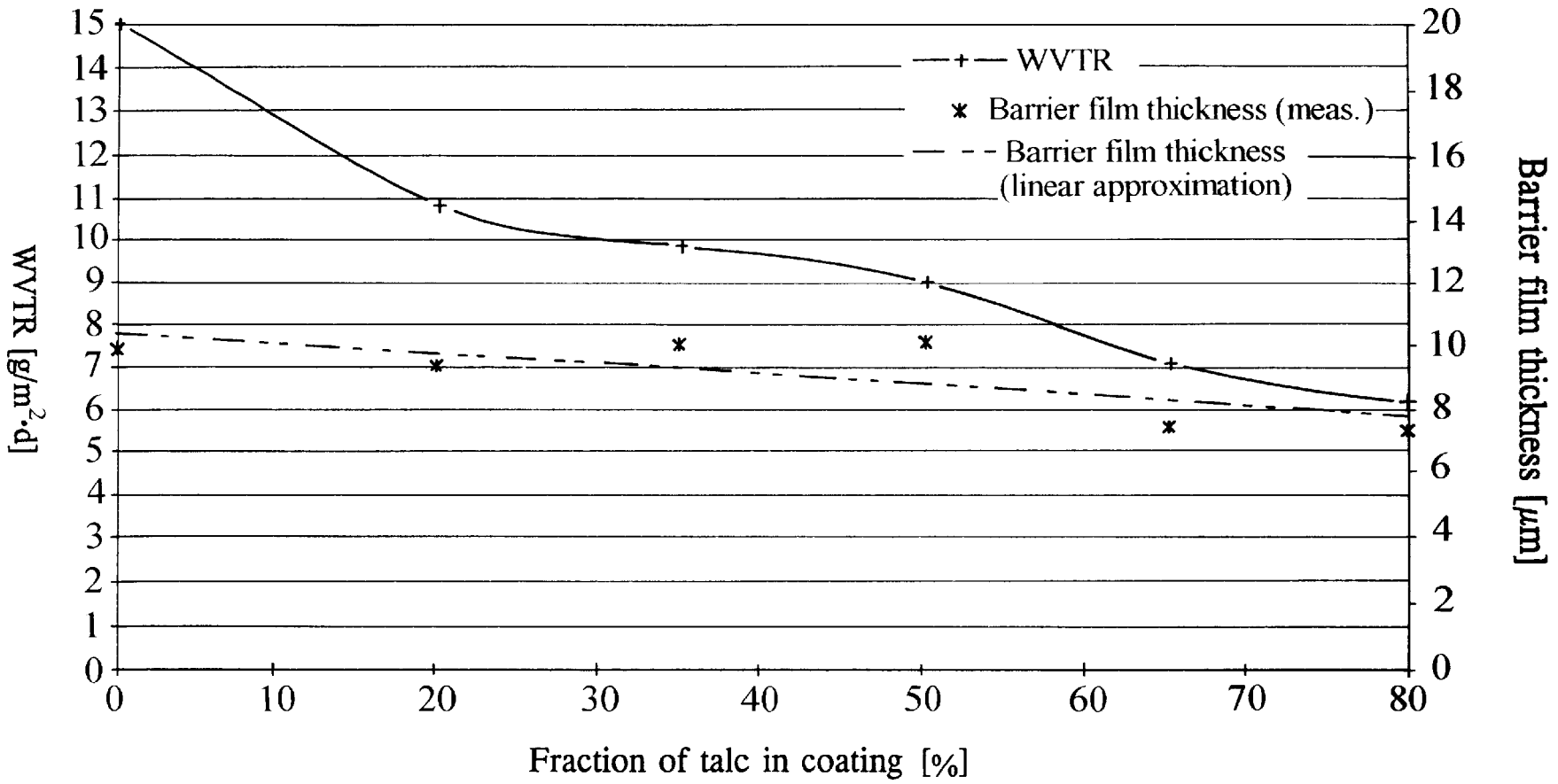

METHOD OF FORMING A TRANSPARENT AND GAS-PERMEABILITY DECREASING COATING TO A PAPER OR BOARD WEB AND A COATING FORMULATION FOR THE METHOD

CROSS-REFERENCE TO RELATED APPLICATION

This application is a continuation-in-part of International Application No. PCT/FI98/00406 filed May 13, 1998.

Method of forming a transparent and gas-permeability decreasing coating to a paper or board web and a coating formulation for the method The present invention relates to a method for forming a coating to a paper or board web. It is an object of the coating method according to the invention to provide paper or board with a barrier resisting the transmission of gases and vapours such as oxygen and water vapour as is required in the art of packaging, for instance.

It is a further object of the invention to provide a coating with the above-mentioned qualities that is also transparent.

It is still another object of the invention to provide a coating with the above-mentioned qualities that also can reduce the adherence risk of the web surfaces in a winded paper of board roll.

The invention also concerns a coating formulation capable of providing the above-described qualities when applied to a paper web.

As known, the gas barrier property required in the packaging industry is conventionally achieved by means of coating the paper or board web with a polymer film. Desirably, the thin-film coatings used herein are capable of preventing penetration of liquids, such as water, and oxygen, water vapour and aroma components as well as oils and greases through them.

Handling of scrapped packaging materials coated with a functional polymer film often involves a high cost due to the poor degrading and recycling properties of these materials.

On the other hand, it is known in the art that a moisture barrier property can be given to a paper web by means of coating the web with a polymer latex having a wax emulsion added thereto. It is also known that these coating components are selected from the group of conventional synthetic polymer lateses such as styrene butadiene, acrylate, styrene acrylate and polyvinyl acetate lateses. Generally, the fraction of polymer lateses in the solids of the coating mixture is very high. Examples of the above-described technology can be found in patent publications. For instance, GB Pat. No. 1,593,331 (filed by J. Vase, Kemi Oy) and FI Pat. Appl. No. 901,928 (filed by Neusiedler A G) teach the methods of said technology.

According to another published reference, the amount of wax dispersion that may conventionally be added to a latex polymer is advantageously maximally about 10 wt-%, while also significantly higher amounts are possible. The waxes most commonly used include paraffin wax, microcrystalline wax, polyethylene wax and a mixture of one of these waxes with at least one other type of wax. A coating formulation thus prepared gives an extremely hydrophobic coating. Of publication closely related to the art, reference can be made to the patent publication WO-A1-9605054 (International Paper Company, USA), in which the above techniques are discussed.

The techniques taught in cited publications are capable of rendering desired barrier properties to the web. However, as the drying of the web leaving the coating section of the paper machine elevates the temperature of the coating applied to the paper web, the adherence risk of the coating in the winding of the paper web becomes so high as to exclude the use of above-mentioned conventional coating formulations when the goal is to achieve a uniform and defect-free coating. A further disadvangae is, that the high fraction of polymer latex in the coating formulation complicates the reuse of the coated paper in pulping, because the amount of anionic contaminants rises excessively high.

It must also be noted that the use of wax emulsions in applications related to the invention lowers the surface energy level of the coating applied to the paper web. The reduced level of surface energy in the coating complicates and, in many cases, even makes it impossible to perform surface sizing with, e.g., starches. The use of waxes also deteriorates the printability qualities of the coating, particularly for water-based inks. The use of wax coatings offers the benefit that it lowers the adherence risk of the coating, the improvement obtained herein is frequently, however, insufficient unless some mineral filler or pigment additive is used.

From the prior art is further known that polymer chains, particularly starch, of natural origin may be added to the latex polymer during its preparation. Paper products which are coated with a polymer latex thus prepared are easier to repulp than paper grades coated with pure polymer latexes. An example of this technique can be found in the patent literature. The technique is taught in publication WO-A-93/11300 (Raision Tehtaat Oy Ab). While the technique can aid the pulping of the recycled paper product, it simultaneously compromises heavily the water-vapour barrier property of the product due to the hydrophilic character of the added starch.

On the other hand the prior art teaches that talc particles can be used in a coating formulations intended for coating a paper or board web. Paper grades parti-cularly suited for gravure printing are coated using a coating formulation containing a significant fraction of talc particles.

Talc particles are also used as a constituent of coating mixtures developed for the coating of release paper grades and of coating mixtures applied to corrugated board grades suitable for flexo printing. Examples of this latter type of technique can be found in the patent literature. For instance, patent publications JP 62-64038 (filed by Oji Paper Co.) and JP 52-118016 (filed by Toyo Ink Mfg. KK) teach the above-described type of technique.

The technology according to these prior-art methods results in good release properties and improved resistance against water vapour transmission. However, due to the high proportion of talc particles with respect to the proportion of polymer latex in the coating mixture, the water vapour barrier property required in foodstuff packages, for instance, cannot be attained.

It is an object of the present invention to overcome the above-described disadvantages and to provide a paper product with sufficient barrier properties, yet suitable for reuse in papermaking and, moreover, permitting dumping by composting.

The goal of the invention is achieved by virtue of applying a coating containing at least one polymer dispersion on a sheet of paper, board or similar cellulosic fiber based web in at least one coating step, wherein the polymer dispersion used contains extremely pure talc particles.

In the context of the present invention, the term extremely pure talc particles is used when reference is made to particles having a degree of purity of about 90–100%.

Advantageously, about 90% of the particles are smaller than 40 μm. Talc having said properties minimizes the need of dispersants in dispersing the talc for the coating paste. High dispersant levels in coating formulations intended to have barrier properties are not favoured.

Herein, the term polymer latex refers to a polymer dispersion having advantageously a 30–60% solids content and advantageously the glass transition point in the range of −20–+70° C. for use in applications according to the invention. For use according to the invention, suitable polymer lateses are selected from the group of synthetic polymer lateses including styrene butadiene, acrylate, styrene acrylate and polyvinyl acetate lateses and polymer dispersions made from a biologically degrading polymer, as well as mixtures of said polymer dispersions.

Accordingly, the polymer dispersion can be a product made starting from a mixture of monomers containing vinyl acetate and at least one ester formed from acryl acid and/or methacryl acid with a lower alcohol (that is, methyl, ethyl, propyl or butyl alcohol) as the main components.

Alternatively, the method can be implemented using a product made starting from a mixture of monomers containing styrene and at least one ester formed from acryl acid and/or methacryl acid with a lower alcohol (that is, a methyl, ethyl, propyl or butyl alcohol) as the main components.

Alternatively, the polymer dispersion can be a product starting from a mixture containing at least one ester formed from acryl acid and/or methacryl acid with a lower alcohol (that is, a methyl, ethyl, propyl or butyl alcohol), and/or copolymers of said compounds, as the main components of the mixture.

In a preferred embodiment, the main component of the polymer dispersion used according to the invention is a biologically degrading polymer such as one based on starch.

The coating formulation according to the invention improves the protection of the paper web against gas and water vapour permeability; simultaneously the coating smooths out any possible roughness of the paper web, thus reducing the consumption of another kind of coating to be subsequently applied to the pre coated web.

The coating mixture prepared according to the invention can be used in coated paper grades principally including different types of packages and wrappers which have to exhibit certain barrier properties against moisture and water vapour penetration and often also protection against oil and grease penetration as well as transmission of gases such as oxygen, for instance.

According to another aspect of the invention, the coating mixture can also be applied on a polymer film known to cause sticking of adjacent web surfaces, whereby the winding of the coated paper without the risk of web adherence to the adjacent surface becomes possible.

The novel coating formulation may also be used for pre treating a paper web which subsequently is coated by an other type of coating intended to render other kinds of properties to the web such as the suitability to be heat sealed.

According to a preferred embodiment of the invention, the proportion of talc particles in the coating mixture is 30–80% of solids in the dry coating mixture. It was noticed that by using talk contents 80% or lower in the coating composition, the composition forms a totally transparent film. This is due to the total adhesion of the polymer and the pigment, whereby no light scattering voids and irregularities are remaining in the coating layer.

The coating mixture formulation used in the invention, in which the above-described polymer dispersion and said kind of extremely pure talc particles are the main components, may be additionally complemented with other pigment or mineral particles, for instance for increasing the opacity of the coating mixture. The addition of waxes and colours is also another possibility to adjust the properties of the coating composition of the invention. Among colours the water-based colours are one preferable source in colouring the composition.

The amount of other pigment or mineral components can be increased up to 30% of the coating mixture solids. Clay, calcium carbonate, titanium dioxide, gypsum and organic pigments can be used as such additional components. The amount of wax may be up to 20% of the coating mixture solids. The amount of colours can vary from 0 to 5% of the overall coating mixture solids.

The surface energy of the polymer film achieved using the coating composition according to the invention can be further regulated by a reaction with siloxanes and poly siloxanes. This can be used for regulating for instance the printability of the film. Also adhesion properties towards different surfaces can be effected by using said further components in the coating compositions.

The invention can be implemented in two alternative ways, the first technique (A) comprising dispersing the talc particles in the aqueous phase using only an anti foaming agent and sodium hydroxide as the additives of the dispersing process, followed by mixing the slurried talc dispersion with a polymer latex. The second technique (B) comprises dispersing the talc particles in a polymer latex using similar additives as mentioned above in very small quantities, complemented with a dispersant and, if required, a wetting agent.

The term coating is in the present context used when reference is made to a formulation suitable for application to a paper or board web so as to act on a paper product as a coating with barrier properties against the transmission of water, water vapour and oxygen, among others.

The coating mixture according to the invention can be applied to the web using conventional coating apparatuses developed for coating a paper or board web. Advantageously, the applied coat weight is 3–30 g/m$^2$ as the solids of the coating mixture.

In the following, the invention will be elucidated with the help of exemplifying embodiments.

EXAMPLE 1

Talc, either milled or granulated, of the afore-characterized quality, was slurried in water according to the following formulation: 1585.6 g water, 4.1 g sodium poly acrylate and 16.2 g sodium carboxy methyl cellulose were weighted into a dispersing vessel. The dispersing was carried out using high agitator speeds in order to disintegrate agglomerated clumps of talc. Talc was added into the mixture in small amounts up to a total of 2700.0 g. In the middle of the talc addition, a further 4.1 g aliquot of sodium poly acrylate and a 2.4 g aliquot of sodium hydroxide were added. The dispersing vessel was provided with a cooling jacket, and the cooling of the mixture was commenced after a 20 min delay from the end of the talc addition step. Thereafter, the mixture was still agitated for another 20 minutes. The product was a talc slurry with 63.0% solids and a viscosity of 200 mPas as measured using a Brookfield LVT viscometer equipped with spindle no. 3 and using a rotation speed of 100 r/min. The finished coating mixture was obtained by mixing the talc slurry with a polymer latex.

EXAMPLE 2

Talc, either milled or granulated of the afore-characterized quality, was slurried in a polymer latex dispersion according to the following formulation: 181.1 g water, 1700.0 g styrene butadiene-based polymer latex (solids content 50%, glass transition point +20° C.), 3.4 g sodium hydroxide and 1.7 g organomodified siloxane were weighted into a dispersing vessel. The dispersing was carried out using high agitator speeds in order to disintegrate agglomerated clumps of talc. Talc was added into the mixture in small amounts up to a total of 1700.0 g. The dispersing vessel was provided with a cooling jacket, and the cooling of the mixture was commenced after a 20 min delay from the end of the talc addition step. Thereafter, the mixture was still agitated for another 20 minutes. The product was a coating mixture with 68.0% solids and a viscosity of 1150 mPas as measured using a Brookfield LVT viscometer equipped with spindle no. 4 and using a rotation speed of 100 r/min.

The next examples illustrate the quality-modifying effect of the coating mixes prepared according to Examples 1 and 2 when applied as a surface coat treatment to finished paper or board webs. The transmission rate measurements performed in the examples were carried out under these conditions: 23° C. ambient temperature and 50% RH. In the measurements, the unit of water permeability was $g/m^2$, the unit of water vapour transmission rate was $g/m^2 \cdot d$ and the unit of oxygen transmission rate was $cm^3/m^2 \cdot d \cdot bar$.

EXAMPLE 3

Figure 2:
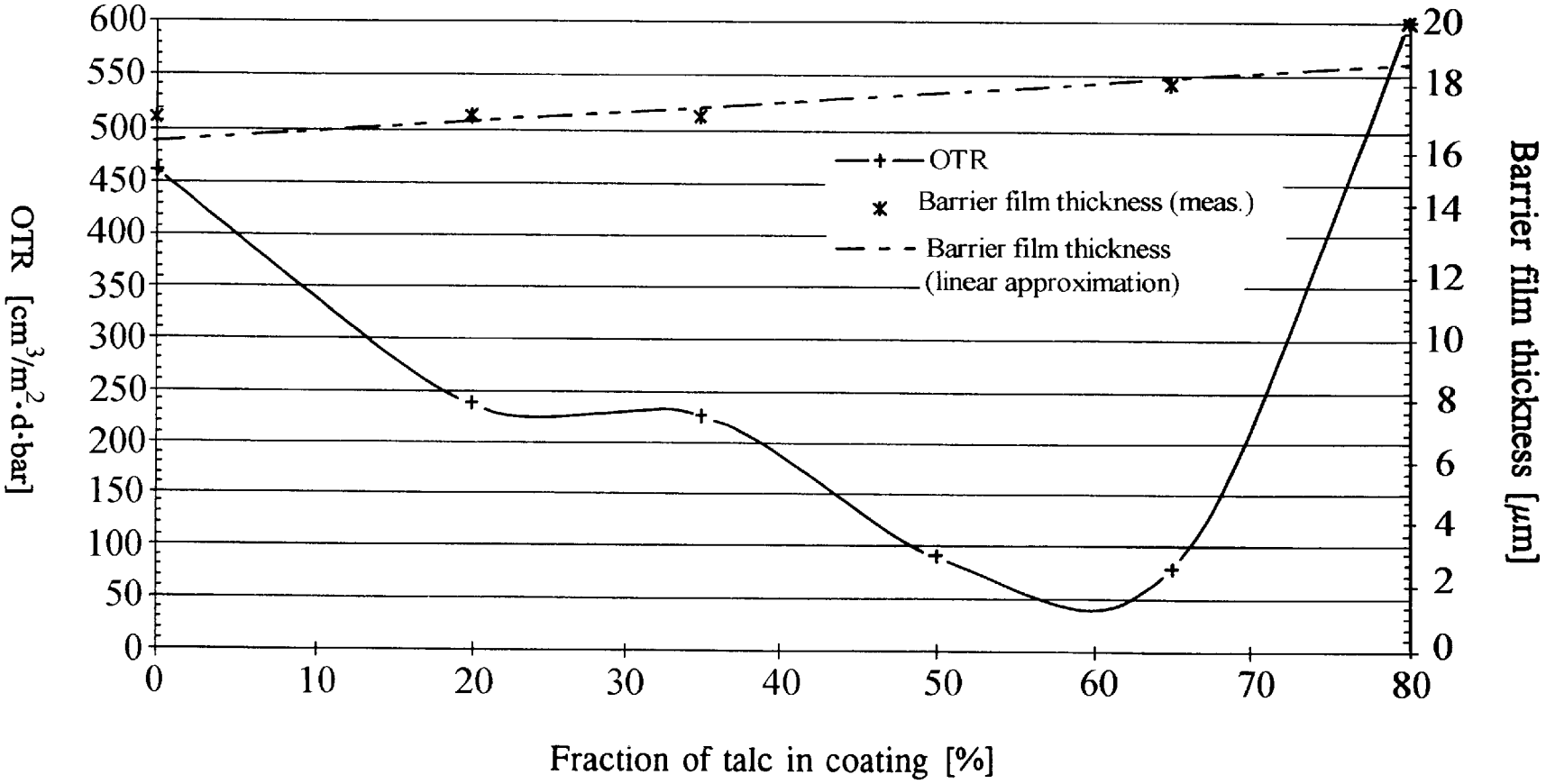

A styrenebutadiene-based coating mixture containing different amounts of talc was applied by means of a laboratory-scale coater to a board web which was subsequently subjected to water vapour transmission rate (WVTR) and oxygen transmission rate (OTR) measurements. The measured transmission rates of the water vapour transmission rate (WVTR) and oxygen transmission rate (OTR) are plotted in the diagrams of FIGS. 1 and 2, respectively.

EXAMPLE 4

The value PA given in Table 1 characterizes the pulping properties of a board grade coated with a talc-containing coating mixture based on a styrenebutadiene polymer latex. The value was determined as follows: a board sheet treated with according to the method was defibered as defined in standard SCAN-C 18:65. The furnish thus prepared was used to make laboratory test sheets. The sheet quality was evaluated on a scale from 0 to 5 in which 0 indicates good pulping properties (no sheet unevenness due to the coating agglomerations) and 5 indicates poor quality (sheet unevenness detectable due to a great number of coating mixture agglomerations or inferior defibering of the pulp).

TABLE 1

| | Fraction of talc in coating mixture | | | | |
|---|---|---|---|---|---|
| | 0 | 20 | 40 | 60 | 80 |
| PA value | 4 | 3 | 2 | 1 | 0 |

EXAMPLE 5

This example elucidates the differences between the transmission properties of the coating application when the same talc-containing coating mixture based on a styrenebutadiene polymer latex is applied on the board either once or twice so that the same final thickness, which was about 14 $\mu$m, of the dried coating is attained in both cases. Table 2 shows the effect of the two different coating application techniques on both the water permeability and the water vapour permeability of the coating.

TABLE 2

| | Number of applied coating layers | |
|---|---|---|
| | 1 layer | 2 layers |
| $Cobb_{60}$ [$g/m^2$] | 1.2 | 0.6 |
| WVTR [$g/m^2 \cdot d$] | 9.8 | 7.5 |

EXAMPLE 6

A bag paper sheet of 80 $g/m^2$ basis weight was first coated with a coating mixture made by dispersing 30 wt-% talc in a styrene acrylate polymer latex and then subsequently coated with a coating mixture containing talc dispersed in a styrene butadiene-based polymer latex. The coat weights applied in both coating steps using the different compositions were about 10 $g/m^2$ solids. The coated sheet was folded and the fold was flattened using a 10 kg mangle roll, after which the sheet was unfolded and rapeseed oil was dropped thereon. The oil did not penetrate the fold line during a day.

EXAMPLE 7

A board sheet of 285 $g/m^2$ basis weight was first coated with a coating mixture made by adding 50% of talc-containing styrene butadiene-based polymer latex with 50% of polyvinyl acetate/acrylate-based polymer latex. After the application of this first coating, another layer was applied thereon using a coating mixture made from talc-containing styrene butadiene-based polymer latex, calcium carbonate and wax. The coat weights applied in both coating steps using the different compositions were about 10 $g/m^2$ solids. The water and water vapour penetration properties of the sheet received by virtue of this combination of coatings are listed in Table 3.

TABLE 3

| | |
|---|---|
| $Cobb_{60}$ [$g/m^2$] | 0.6 |
| WVTR [$g/m^2 \cdot d$] | 2.8 |

EXAMPLE 8

The value KS in Table 4 below characterizes the heat sealing properties of board treated with the novel coating. The application was made by coating a bag paper sheet of 80 $g/m^2$ basis weight with a formulation containing 30% talc dispersed in poly hydroxy butyrate covalerate polymer latex. The coat weight applied was about 6 $g/m^2$ solids. The heat-sealing tests were performed in a so-called patch sealing apparatus. The value KS was determined as follows: the treated sheet was sealed with the coated side facing the backing, and the quality of the seal was subsequently evaluated on a scale from 0 to 5, where 0 indicates poor heat-sealing ability (evidenced as no intersheet adherence) and 5 indicates good heat-sealing ability (causing complete interfiber tear when pulling the sealed papers apart from each other).

TABLE 4

| | Sealing temperature [° C.] | | | | |
|---|---|---|---|---|---|
| | 100 | 120 | 140 | 160 | 180 |
| KS | 2 | 2 | 2 | 3 | 5 |

EXAMPLE 9

A board sheet of 285 g/m$^2$ basis weight was first coated with a coating mixture made by dispersing 50% of talc with an equivalent weight of a polymer mixture containing styrene butadiene-based polymer latex mixed in varying ratios with butyl acrylate-based polymer latex (having a glass transition point of +60° C.). The coat weight applied in all tests was about 12 g/M$^2$ solids. The water penetration properties of the sheet by virtue of this combination of coatings are listed in Table 5.

TABLE 5

| Fraction of styrene butadiene latex in polymer latex mixture [%] | 0 | 10 | 20 | 40 | 60 | 80 | 90 | 100 |
|---|---|---|---|---|---|---|---|---|
| $Cobb_{90}$ [g/m$^2$ | 2.1 | 1.5 | 2.6 | 2.7 | 5.0 | 10.3 | 20.1 | 32.6 |

What is claimed is:

1. A method of forming a transparent and gas-permeability decreasing coating on a cellulosic fiber-based web, said method comprising the steps of:

providing a slurry, wherein said slurry comprises:

water, at least one wax-free, polymer dispersion, talc particles having a degree of purity of 90–100%, an anti-foam agent, and sodium hydroxide; and applying said slurry to said cellulosic fiber-based web.

2. A method of forming a transparent and gas-permeability decreasing coating on a cellulosic fiber-based web, according to claim 1, wherein said coating provides a barrier against the passage of permeants selected from the group consisting of liquids, vapors, gasses, greases, and oils.

3. A method of forming a transparent and gas-permeability decreasing coating, according to claim 1, wherein about 90% of said talc particles are smaller than 40 micrometers.

4. A method of forming a transparent and gas-permeability decreasing coating on a cellulosic fiber-based web, said method comprising the steps of:

providing a slurry, wherein said slurry comprises:

water, talc particles having a degree of purity of 90–100%, at least one wax-free, polymer dispersion;

an anti-foam agent, a wetting agent; and sodium hydroxide; and applying said slurry to said cellulosic fiber-based web.

5. A method of forming a transparent and gas-permeability decreasing coating, according to claim 1, wherein said talc particles comprise in the range 30% to 80% of the total solids of said coating.

6. A method of forming a transparent and gas-permeability decreasing coating on a cellulosic fiber-based web, said method comprising the steps of:

providing a slurry, wherein said slurry comprises:

water, at least one wax-free, polymer dispersion, wherein said polymer dispersion is formed from a mixture of monomers containing styrene and butadiene as the main components of the mixture; talc particles having a degree of purity of 90–100%, an anti-foam agent, and sodium hydroxide; and applying said slurry to said cellulosic fiber-based web.

7. A method of forming a transparent and gas-permeability decreasing coating on a cellulosic fiber-based web, according to claim 1, wherein said polymer dispersion, is a product made starting from a mixture of monomers containing vinyl acetate and at least one ester formed from acrylic acid and/or methacrylic acid with at least one lower alcohol selected from the group consisting of a methyl alcohol, ethyl alcohol, propyl alcohol and butyl alcohol, and/or copolymers of said compounds, as the main components of the mixture.

8. A method of forming a transparent and gas-permeability decreasing coating on a cellulosic fiber-based web, according to claim 1, wherein said polymer dispersion used is a product made starting from a mixture of monomers containing styrene and at least one ester formed from acrylic acid and/or methacrylic acid with at least one lower alcohol selected from the group consisting of a methyl alcohol, ethyl alcohol, propyl alcohol and butyl alcohol as the main components of the mixture.

9. A method of forming a transparent and gas-permeability decreasing coating on a cellulosic fiber-based web, according to claim 1, wherein said polymer dispersion used is a product made starting from a mixture of monomers containing at least one ester formed from acrylic acid and/or methacrylic acid with at least one lower alcohol selected from the group consisting of a methyl-alcohol, ethyl alcohol, propyl alcohol and butyl alcohol, and/or copolymers of said compounds, as the main components of the mixture.

10. A method of forming a transparent and gas-permeability decreasing coating on a cellulosic fiber-based web, said method comprising the steps of:

providing a slurry, wherein said slurry comprises:

water, at least one wax-free, polymer dispersion, wherein said polymer dispersion, consists mainly of biodegradable materials;

talc particles having a degree of purity of 90–100%, an anti-foam agent, and sodium hydroxide; and applying said slurry to said cellulosic fiber-based web.

11. A method of forming a transparent and gas-permeability decreasing coating on a cellulosic fiber-based web, said method comprising the steps of:

providing a slurry, wherein said slurry comprises:

water, at least one wax-free, polymer dispersion, wherein said polymer dispersion is made from a mixture of monomers containing styrene and at least one ester formed from acrylic acid and/or methacrylic acid with at least one lower alcohol selected from the group consisting of methanol, ethanol, propanol, and butanol as the main components of said mixture, talc particles having a degree of purity of 90–100%; and applying said slurry to said cellulosic fiber-based web.

12. A method of forming a transparent and gas-permeability decreasing coating on a cellulosic fiber-based web, said method comprising the steps of:

providing a slurry, wherein said slurry comprises:

water, at least one wax-free, polymer dispersion, wherein said polymer dispersion consists essentially of a biodegradable material, talc particles having a degree of purity of 90–100%; and applying said slurry to said cellulosic fiber-based web.

13. A method of forming a transparent and gas-permeability decreasing coating on a cellulosic fiber-based web, said method comprising the steps of:

providing a slurry, wherein said slurry comprises:

water, at least one wax-free, polymer dispersion, wherein said polymer dispersion is formed from a mixture of monomers containing styrene and butadiene as the main components of the mixture; talc particles having a degree of purity of 90–100%; and applying said slurry to said cellulosic fiber-based web.

* * * * *